US008144884B2

(12) United States Patent
Van den Heuvel et al.

(10) Patent No.: US 8,144,884 B2
(45) Date of Patent: Mar. 27, 2012

(54) STAND-ALONE MICROPHONE TEST SYSTEM FOR A HEARING DEVICE

(75) Inventors: Koen Van den Heuvel, Hove (BE); Michael Goorevich, Dulwich Hill (AU)

(73) Assignee: Cochlear Limited, Macquarie University, NSW (AU)

( * ) Notice: Subject to any disclaimer, the term of this patent is extended or adjusted under 35 U.S.C. 154(b) by 1048 days.

(21) Appl. No.: 11/135,524

(22) Filed: May 24, 2005

(65) Prior Publication Data

US 2005/0259829 A1 Nov. 24, 2005

Related U.S. Application Data

(60) Provisional application No. 60/573,419, filed on May 24, 2004.

(51) Int. Cl.
*H04R 29/00* (2006.01)

(52) U.S. Cl. ..... 381/60; 381/312; 381/314; 381/322; 381/323

(58) Field of Classification Search ..... 381/60, 381/314, 323, 324, 326, 312, 322; 702/57
See application file for complete search history.

(56) References Cited

U.S. PATENT DOCUMENTS

| | | | | |
|---|---|---|---|---|
| 4,879,750 | A * | 11/1989 | Nassler | 381/325 |
| 5,703,797 | A | 12/1997 | Russell | |
| 6,118,877 | A | 9/2000 | Lindemann et al. | |
| 6,671,643 | B2 * | 12/2003 | Kachler et al. | 702/116 |
| 6,674,862 | B1 | 1/2004 | Magilen | |
| 6,712,754 | B2 * | 3/2004 | Miller et al. | 600/25 |
| 6,792,114 | B1 * | 9/2004 | Kates et al. | 381/60 |
| 6,879,692 | B2 | 4/2005 | Nielsen et al. | |
| 2002/0048374 | A1 | 4/2002 | Soil et al. | |
| 2002/0176584 | A1 | 11/2002 | Kates | |

FOREIGN PATENT DOCUMENTS

WO WO9700593 * 6/1995

OTHER PUBLICATIONS

Office Action for Australian Patent Application No. 2005202243 dated Mar. 12, 2009.

* cited by examiner

*Primary Examiner* — Brian Ensey
*Assistant Examiner* — Ryan Robinson
(74) *Attorney, Agent, or Firm* — Kilpatrick, Townsend & Stockton, LLP

(57) ABSTRACT

The present invention provides a stand-alone microphone test system for a hearing device, comprising a hearing device having at least one microphone, a sound source in communication with the hearing device, wherein, when in operation, the sound source receives a signal from the hearing device, and a mold oriented to hold the hearing device and the sound source such that output from the sound source may be directed to the at least one microphone. There is also provided a stand-alone microphone test method for a hearing device, comprising providing a test signal/sequence output to a sound source/receiver, providing a reference signal to a comparator, receiving output from the sound source/receiver in a microphone, transmitting the received signal to the comparator, comparing the received signal with the reference signal, and providing a test result.

22 Claims, 2 Drawing Sheets

STAND-ALONE MICROPHONE TEST SYSTEM FOR A HEARING DEVICE

CROSS-REFERENCE TO RELATED APPLICATIONS

This application claims the priority of U.S. Provisional Patent Application 60/573,419, entitled, "Stand-Alone Microphone Test System for Hearing Device," and filed May 24, 2004. The entire disclosure and contents of the above applications are hereby incorporated by reference.

BACKGROUND

1. Field of the Invention

The present invention relates generally to stand-alone microphone test devices and systems for hearing aids and hearing prostheses, and to a testing method for microphones in such devices.

2. Related Art

A prosthetic hearing device or hearing aid is used to aid patients who have a hearing deficiency. Microphone quality greatly influences a patient's satisfaction and ability to discern sound. The available methods and apparatus used to test the quality of the microphone are inadequate, expensive, and/or prone to error or uncertainty.

Microphones degrade in two primary ways. First, a microphone may degrade due to natural degradation over time. Second, a microphone may degrade by a significant and/or sudden failure, not caused by natural degradation.

One typical measurement technique for measuring the frequency response of a microphone is the speech and/or sound perception of the user. This requires time and effort as a complete speech test should be conducted in a reproducible environment. Typically, an effective technical measurement technique for measuring the frequency response of a microphone is to utilize specialized and expensive analysis equipment. For example, some systems require that the hearing device be connected to an auxiliary computer to conduct a test.

The object of the present invention is to provide a stand alone microphone test system that does not require elaborate, complex equipment, and may be used by the hearing device recipient.

SUMMARY

According to one aspect of the present invention, there is provided a stand-alone microphone test device for a hearing device, said device including a housing adapted to receive a hearing device having at least one microphone, and a sound source operatively adapted to communicate with the hearing device, said housing operatively maintaining the sound source and said or each microphone in a predetermined relationship, so that operatively, when the sound source receives a test signal from the hearing device, it produces an acoustic signal which is received by said or each microphone.

According to a second aspect of the present invention, there is provided a stand-alone microphone test system for a hearing device, said test system including a test device having a housing adapted to receive a hearing device having at least one microphone, and a sound source operatively adapted to communicate with the hearing device, said housing operatively maintaining the sound source and said or each microphone in a predetermined relationship, said hearing device further including a comparator and means for generating a test signal for transmission to said sound source, so that operatively, when the sound source receives a test signal from the hearing device, it produces an acoustic signal which is received by said or each microphone, said microphone detecting said signal and communicating a corresponding received signal to said comparator, said hearing device further sending a reference signal to said comparator, so that said received signal and said reference signal can be compared to determine the quality of the or each microphone.

The test system may further include a reference signal being sent to a comparator, which then compares the reference signal with the signal transmitted by the microphone to determine the quality of the microphone.

According to another aspect of the present invention, there is provided a microphone test method for a hearing device, including the steps of:

providing a housing adapted to receive a hearing device having at least one microphone, and a sound source operatively adapted to communicate with the hearing device;

Placing said hearing device into said housing;

Placing said hearing device into communication with said sound source

Generating a test signal in said hearing device and communicating said signal to said sound source, so that said sound source generates an acoustic signal;

receiving said acoustic signal from the sound source using said or each microphone, processing the received acoustic signal to determine the quality of the or each microphone.

It will be understood that the present invention is applicable to any hearing device which is reliant upon microphone quality, for example hearing aids, or hearing implants.

BRIEF DESCRIPTION OF THE DRAWINGS

The invention will be described in conjunction with the accompanying drawings, in which.

DETAILED DESCRIPTION

An exemplary embodiment of the present invention provides a stand-alone microphone test device and method that is easy to use and economical. The stand-alone test may be used by patients who wear a hearing device and other non-medical personnel without extensive training or expertise.

In some current systems, a user may be provided with an indication on an LED or LCD that there is sound being produced, but the internal diagnostics are inadequate to determine the quality of the microphone. A technician or other individual may listen to an attached earphone to judge the quality of the speech processor, but may not be able to determine the quality or condition of the microphone, without using an auxiliary testing system. A technician or clinician may utilize a separate commercial-off-the-shelf (COTS) microphone test system, such as a FONIX™ box, to measure the quality of a microphone.

According to an embodiment of the present invention, a user may perform a microphone test on a hearing device, such as a behind-the-ear (BTE) device, using, for example, attachable earphones as a sound source. Both the hearing device and at least one earphone may be placed in a mold, or other position orienting device, to keep the earphone in a fixed position relative to the microphone to perform a test. Preferably, the fixed position created by the mold may also eliminate or reduce the ambient noise.

In an embodiment of the present invention, a hearing device contains a digital signal processor (DSP) that may use maximum length sequence (MLS) based techniques to measure the impulse response of the system. This measured impulse response may be compared with a reference signal, by which the quality of the microphones may be judged. In embodiments of the present invention, a visual indication may be used to indicate the quality of the microphones on an LED or LCD. Furthermore, other analysis mechanisms may be utilized in conjunction with a stand-alone test system, such as a spectral analyzer or dynamic range analyzer, to increase the robustness of the test and/or presentation of test results.

Figure 1:
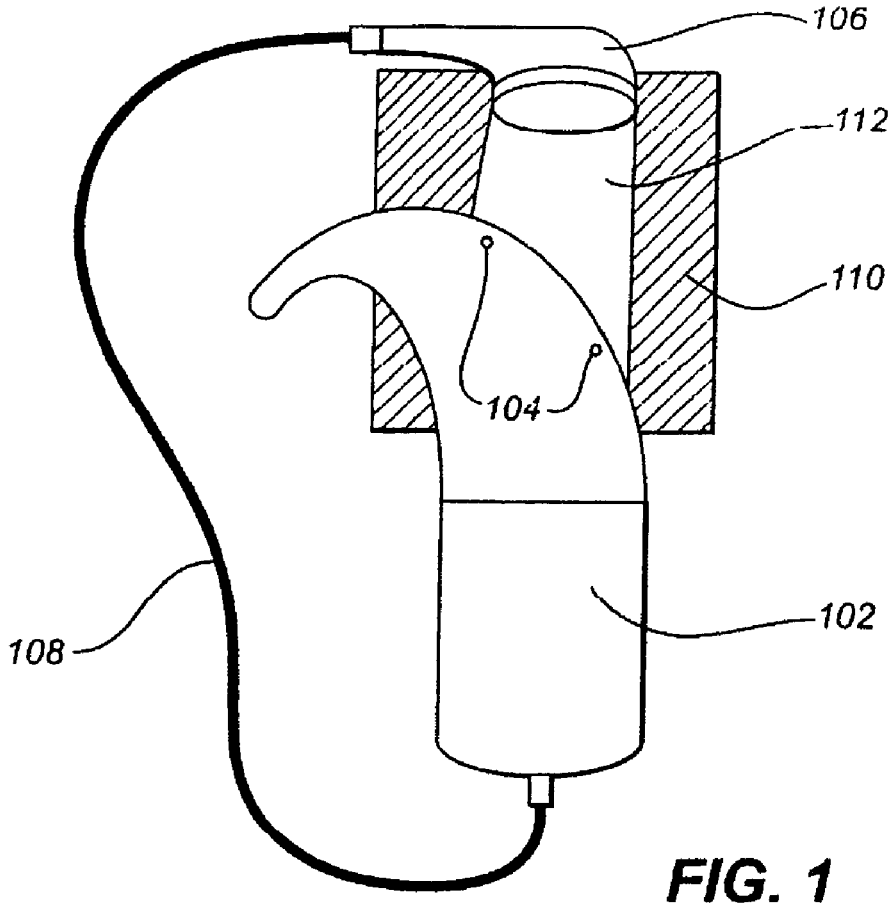
FIG. 1 shows a schematic view of a hearing device configured for a stand-alone microphone test in accordance with an embodiment of the present invention.

FIG. 1 shows a schematic view of a hearing device configured for a stand-alone microphone test in accordance with an embodiment of the present invention. Hearing device 102 contains two microphones 104. Although, two microphones are shown in FIG. 1, it should be appreciated that any suitable number of microphones may be utilized in such hearing devices, such as 1, 2, 3 or more than 3. Hearing device 102 is configured to communicate with attachable earphone 106 through wire 108. While a wire, such as wire 108, is shown in FIG. 1, it should be appreciated that wireless communication may also be utilized in embodiments of the present invention. Hearing device 102 and earphone 106 are shown in mold 110.

Mold 110 may be a partial enclosure, as shown in FIG. 1, or may completely enclose hearing device 102 and earphone 106, using either a unibody or multi-part mold. Mold 110 orients hearing device 102 and earphone 106 such that a repeatable distance and orientation may be achievable in successive tests. Mold 110 forms a sound channel 112 to direct sound from earphone 106 toward microphones 104. The arrangement of mold 110 and channel 112 helps to shield microphones 104 from external noises or sounds during the test.

The mold is preferably made of plastic, forming a snug fit over the speech processor. This plastic could be of ABS type, similar to the material a speech processor or hearing aid might be made from. Further, a type of rubber polymer such as Kraton could also line the ABS mold, so that when in contact with the speech processor (underside) and in contact with the earphones (top side) of the mold, a snug fit with acoustic sealing properties around the microphone ports is obtained. However, it will be appreciated that any suitable material may be employed.

Figure 2:
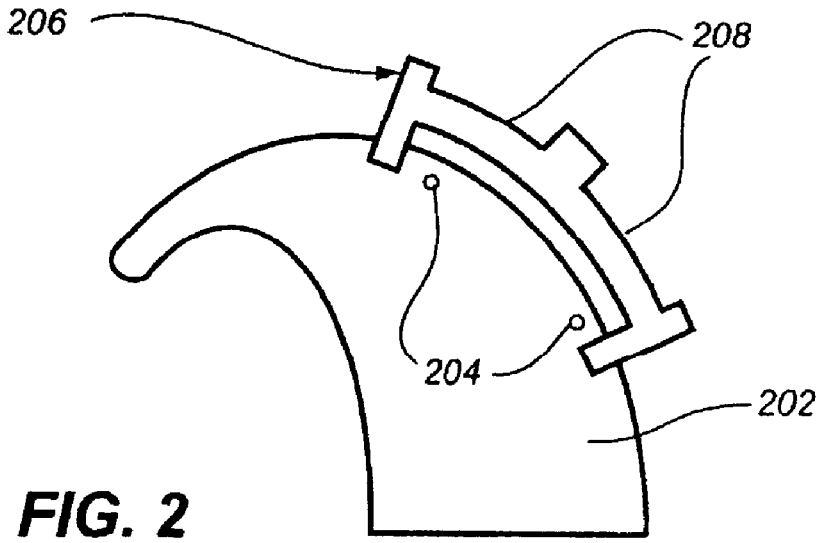
FIG. 2 shows a schematic view of a hearing device configured for a stand-alone microphone test in accordance with an embodiment of the present invention.

In an embodiment of the present invention as shown in FIG. 2, a schematic view of a hearing device 202 configured for a stand-alone microphone test is shown. Hearing device 202 contains two microphones 204. Although, two microphones are shown in FIG. 2, it should be appreciated that any suitable number of microphones may be utilized in such hearing devices, such as 1, 2, 3 or more than 3. Hearing device 202 is configured to removably connect to a housing in the form of mold 206. Mold 206 is constructed such that it may be connected to hearing device 202 in one location that provides a repeatable distance and orientation between microphone 204 and sound source (not shown). Mold 206 may attach to hearing device 202 by clips, tabs, snaps, hook-and-loop fasteners, adhesive, tension forces, etc. Mold 206 is shown with two receptacles 208 for holding or connecting to at least one sound source. Thus, mold 206 allows for independent testing of each of microphones 204, with one or more sound sources. However, it should be appreciated that mold 206 may be modified to provide only one receptacle and thus allow for testing of two microphones with one sound source. Mold 206 orients hearing device 202 and the sound source such that a repeatable distance and orientation may be utilized in successive tests. Mold 206 may be a partial enclosure, as shown in FIG. 2, or may completely enclose hearing device 202, using either a unibody or multi-part mold.

Suitable sound sources of the present invention include earphones, headphones, speakers, and any other sound producing mechanism now or later developed that may produce a sound or test signal, noise, sine, MLS noise, etc.

Figure 3:
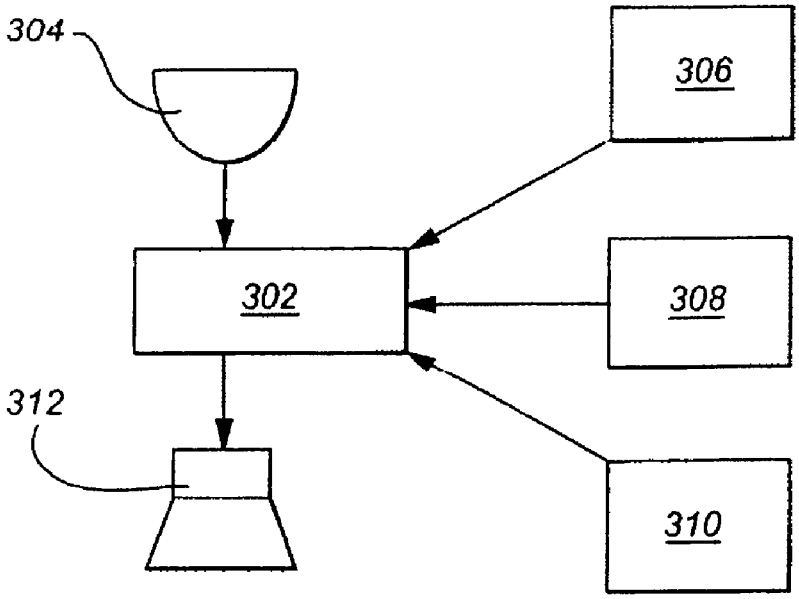
FIG. 3 PRIOR ART
FIG. 3 shows a prior art method of testing a hearing device.

FIG. 3 shows a prior art method of testing a microphone. A master switch 302 is used as the controller for input from microphone 304 and external input 306. Master switch 302 also contains a test tone generator 308 and a memory 310. The sound is then output to receiver 312 and analyzed for quality.

Figure 4:
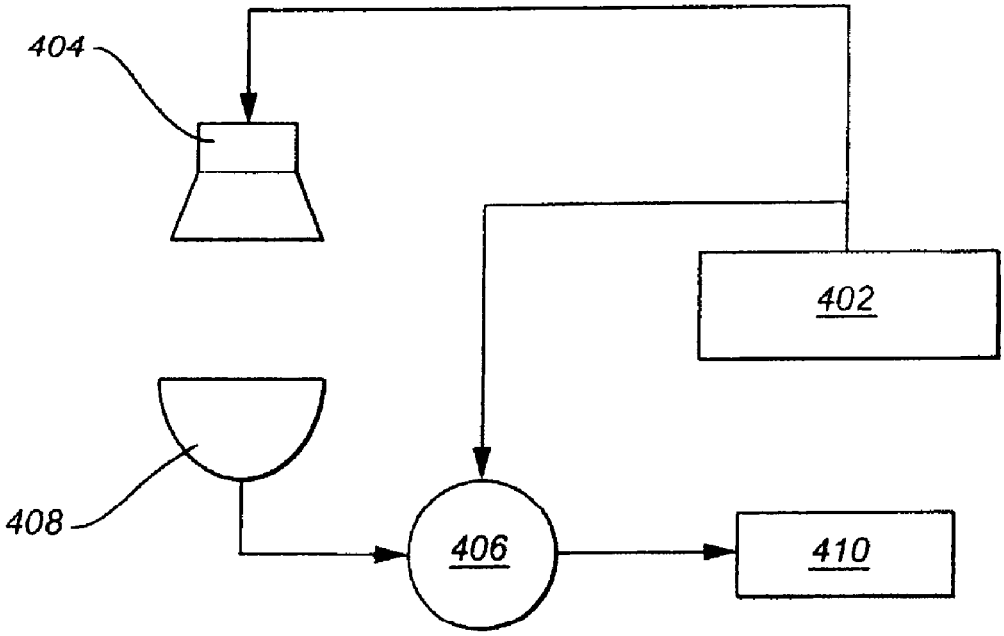
FIG. 4 shows a method of testing a hearing device in accordance with an embodiment of the present invention.

According to an embodiment of the present invention, the impulse response of a standard system may be used as a reference response to compare a system under test. In FIG. 4, a hearing device contains a test signal/sequence output generator 402 that provides a sound signal to receiver 404 and a reference signal to a comparator 406. Microphone 408 receives Sound output from receiver 404 and transmits the signal to comparator 406. Comparator 406 compares the reference signal received from generator 402 with the signal received by microphone 408 and provides a test result 410. Test result 410 may be displayed in a visual and/or audible manner, with any suitable use of LEDs, LCDs and other similar indicators, singly or in combination.

According to an embodiment of the present invention, to check the quality of the microphone, it is useful to isolate the microphone response from the system response. Thus, the earphone response may be subtracted from the system response to obtain the microphone response:

$$\text{Microphone Impulse} = \text{System Impulse} - \text{Earphone Impulse} - \text{Noise}$$

The first condition for this comparison is that the earphone impulse response should be constant. The second condition for the comparison is that the measured impulse response should not be influenced by other sources such as external noise.

Several factors may have an impact on the constancy of the earphone response, such as variation between different sound sources and changing of the response of a particular sound source over time. If the variation between sound sources is determined to be a problem, a reference response per system may be measured during manufacture to lessen the impact. If the sound source fails, the system may be configured to indicate a system failure to avoid potentially faulty tests.

The measured impulse response may also be affected by other sources such as reflections (echos) from the environment and environmental noise.

To address the problems associated with external noise, an embodiment of the present invention may use a quasi-anechoic measurement method using maximum length sequence (MLS) signals, and cross-correlation of the input and the output to get the impulse response of the system.

An MLS based algorithmic measurement provides a cross-correlation method that may be used to compute the impulse response and reduce background noise so that measurements may be performed in relatively noisy environments. The use of averaging techniques further increases the S/N ratio. Furthermore, the measured distortion of the system may be spread throughout the computed impulse response.

In order for MLS to work accurately, the MLS signal length should be longer than the impulse response of the system under test or have the same length and the system under test should be time-invariant, at least during the measurement interval.

In embodiments of the present invention, an FFT may also be used to calculate the frequency response from the impulse response.

In an embodiment of the present invention, a hearing device may automatically detect that a mold or sound source has been connected to the hearing device. Thus, a hearing device may further be configured to automatically enter an accessory mode or testing mode. A TEST option or other menu option may be selected from an LCD to initiate a test. The LCD may provide an indication of the next step or steps to be performed, or there may be LEDs to indicate the step or steps to be performed. Either automatically or upon activation of a particular button or knob, a signal may be produced for the test. The DSP in the hearing device may measure the frequency and/or phase response using FFT or any other suitable mechanism now known or later developed. If the microphone response is within predefined parameters, an audible or visual indication may be provided to indicate the test was successful. Likewise, other audible or visual indicators may be provided to indicate a problematic condition, and to further distinguish the type and/or level of the problem. Auto-correct features may also be incorporated into the hearing device.

The present invention thus provides an inexpensive test system, utilizing existing and/or easily obtained components such as a sound source and an associated mold. A stand-alone test system may allow for quicker and easier analysis and thus may further reduce the number of processors returned for repair.

Although the present invention has been described with reference to an exemplary hearing device, any suitable components and/or configuration now or later known may be utilized in the present invention.

Although the present invention has been fully described in conjunction with the certain embodiments thereof with reference to the accompanying drawings, it is to be understood that various changes and modifications may be apparent to those skilled in the art.

What is claimed is:

1. A microphone test method for testing at least one microphone of a hearing device, the method comprising:

connecting the hearing device to a sound source external to the hearing device, the hearing device having the at least one microphone;

providing a housing adapted to receive the hearing device and the sound source, and wherein the housing is further adapted to do at least one of disposing the sound source at a repeatable distance from the hearing device and disposing the sound source in a repeatable orientation relative to the hearing device;

placing the hearing device and the sound source into the housing, wherein the housing provides a sound channel between the sound source and at least one of the at least one microphones;

placing the hearing device into communication with the sound source by generating a test signal in the hearing device and communicating the signal to the sound source, so that the sound source generates an acoustic signal;

receiving the acoustic signal from the sound source, via the sound channel, using at least one of the at least one microphone, wherein the acoustic signal passes directly from the sound source to the at least one microphone via the sound;

processing the received acoustic signal to determine a test result regarding a quality of at least one of the at least one microphone; and providing an indication regarding the test result.

2. A method according to claim 1, wherein the hearing device further includes a comparator and means for generating a reference signal and communicating the reference signal to the comparator, the comparator comparing the received signal and the reference signal to determine the quality of the at least one microphone.

3. A method according to claim 2, wherein the test signal is a maximum length signal, and the comparator performs a cross correlation of the received signal and the reference signal to determine the impulse response of the system.

4. The method of claim 1, wherein processing the received acoustic signal to determine the test result regarding the quality comprises:

measuring a microphone response using the received acoustic signal; and determining whether the microphone response is within predefined parameters.

5. The method of claim 1, wherein providing an indication regarding the determined test result comprises:

providing a visual indication regarding the test result using an LED.

6. The method of claim 1, wherein providing an indication regarding the determined test result comprises:

providing a visual indication regarding the test result using an LCD.

7. A stand-alone microphone test system comprising:

a hearing device comprising:

a test signal generator configured to generate a test signal; and at least one microphone configured to receive an acoustic signal;

a comparator configured to receive a signal from at least one of the at least one microphones and generate a test result regarding a quality of the at lease one of the at least one microphones; and an indicator configured to provide an indication of the generated test result;

a sound source configured to be connected to the hearing device external to the hearing device and, in response to the generated test signal, generate the acoustic signal; and a housing adapted to receive the hearing device and the sound source, wherein the housing comprises a sound channel to operatively direct sound from the sound source to at least one of the at least one microphones such that the sound passes directly from the sound source to the at least one microphone via the sound channel, and wherein the housing is further adapted to do at least one of disposing the sound source at a repeatable distance from the hearing device and disposing the sound source in a repeatable orientation relative to the hearing device.

8. The test system of claim 7, wherein the test signal generator is further configured to provide a reference signal to the comparator, and wherein the comparator is further configured compare the reference signal to the signal from the at least one of the at least one microphones in generating the test result.

9. The test system of claim 8, wherein the test signal is a maximum length signal, and wherein the comparator is configured to perform a cross correlation of the received signal and the reference signal to determine an impulse response of the system.

10. The test system of claim 7, wherein the hearing device further comprises:

a processor configured to measure a microphone response for at least one of the at least one microphones using the received acoustic signal, and determine whether the microphone response is within predefined parameters.

11. The test system of claim 7, wherein the indicator is an LED.

12. The test system of claim 7, wherein the indicator is an LCD.

13. A method according to claim 1, wherein the sound source is integral with the housing.

14. The test system of claim 7, wherein the sound source is integral with the housing.

15. The method according to claim 1, wherein the hearing device is a hearing aid.

16. The method according to claim 1, wherein the hearing device is a sound processor for a cochlear implant.

17. The test system of claim 7, wherein the hearing device is a hearing aid.

18. The test system of claim 7, wherein the hearing device is a sound processor for a cochlear implant.

19. The method of claim 1, wherein the housing is a unibody molded structure comprising: the sound channel, a first receptacle, and a second receptacle;

wherein the first receptacle is configured to receive at least a portion of the hearing device, the portion comprising the at least one microphone; and wherein the second receptacle is configured to receive the sound source.

20. The stand-alone microphone test system of claim 7, wherein the housing is a unibody molded structure comprising:

the sound channel, a first receptacle is configured to receive at least a portion of the hearing device, the portion comprising the at least one microphone; and a second receptacle is configured to receive the sound source.

21. The method of claim 1, wherein the housing both disposes the sound source at the repeatable distance from the hearing device and disposes the sound source in the repeatable orientation relative to the hearing device.

22. The stand-alone microphone test system of claim 7, wherein the housing is further adapted both to dispose the sound source at the repeatable distance from the hearing device and dispose the sound source in the repeatable orientation relative to the hearing device.

* * * * *